US005902754A

United States Patent [19]

Nishijima et al.

[11] Patent Number: 5,902,754

[45] Date of Patent: May 11, 1999

[54] HIGHLY SMOOTH FIBER, FABRIC, AND FORMED ARTICLE

[75] Inventors: Masaru Nishijima; Masayasu Suzuki, both of Shigaken, Japan

[73] Assignee: Chisso Corporation, Osaka, Japan

[21] Appl. No.: 08/836,062

[22] PCT Filed: Aug. 2, 1996

[86] PCT No.: PCT/JP96/02194

§ 371 Date: Apr. 29, 1997

§ 102(e) Date: Apr. 29, 1997

[87] PCT Pub. No.: WO97/08377

PCT Pub. Date: Mar. 6, 1997

[30] Foreign Application Priority Data

Aug. 31, 1995 [JP] Japan ..... 7-248774

[51] Int. Cl.[6] ..... D02G 3/00

[52] U.S. Cl. ..... 442/99; 442/187; 442/199; 442/307; 442/311; 442/333; 442/361; 428/361; 428/378

[58] Field of Search ..... 428/361, 378; 442/99, 187, 199, 307, 311, 333, 361

[56] References Cited

U.S. PATENT DOCUMENTS 3,992,332 11/1976 Joseph .
4,663,200 5/1987 Katsuaki et al. .
5,258,129 11/1993 Tomohiro et al. .

FOREIGN PATENT DOCUMENTS 676 981 8/1966 Belgium .
0 056 095 7/1982 European Pat. Off. .
1 246 134 9/1971 United Kingdom .

*Primary Examiner*—Terrel Morris
*Attorney, Agent, or Firm*—McDermott, Will & Emery

[57] ABSTRACT

The present invention relates to a highly smooth fiber comprising a fiber produced from a thermoplastic resin on which a mixed composition is deposited in an amount of 0.1 to 2.0 percent by weight of said fiber, said mixed composition comprising 50 to 85 percent by weight of a composition (A) consisting of an alkyl phosphate salt having an average number of carbon atoms of 6 to 14 and/or an alkyl phosphate salt having an average number of carbon atoms of 10 to 22 to which a polyoxyalkylene group is added; and 15 to 50 percent by weight of a composition (B) consisting of a polyoxyalkylene modified silicone containing amide group.

The present present invention also relates to a fabric or formed articles produced from such a highly smooth fiber.

11 Claims, 2 Drawing Sheets

HIGHLY SMOOTH FIBER, FABRIC, AND FORMED ARTICLE

BACKGROUND OF THE INVENTION

1. Field of the Invention

The present invention relates to a highly smooth fiber having hydrophilic groups. More specifically, the present invention relates to a highly smooth fiber having an excellent processability in terms of dispersion and fiber opening using air flow or a carding machine, produced by depositing a specific fiber treatment agent, thereby providing anti-static properties, high smoothness, and hydrophilic properties to a fiber consisting of a low-melting thermoplastic resin. The present invention also relates to a fabric or formed articles produced from such a highly smooth fiber.

2. Description of the Related Art

In various fields represented by the hygienic material field, there are used woven and non-woven fabrics produced from thermoplastic resins such as polyolefins, polyesters and polyamides. These resins are uniformly dispersed using wet or dry processes, and subsequently adhered with hot air, compressed with hot rolls, and knitted or weaved using high-pressure water flow or metal needles.

However, since fibers made of thermoplastic resins such as polyolefins produce much fiber—fiber and fiber-metal friction in the dry carding process, static electricity is generated and twining occurs.

Because of the present discreteness and improved quality and performance of products, functional thermoplastic resins are often used. In some of these applications, there are used fibers which produce more fiber—fiber and fiber-metal friction than do conventional fibers. Such fibers include resins suitable for low-temperature processing and those having high tackiness. Also, for improving processing efficiencies, increase in processing speed is attempted.

For these reasons, various fiber finishing agents have been proposed for imparting anti-static properties or smoothness to the fibers. Widely used fiber finishing agents include waxes, fatty acid-based fats and oils, and quaternary ammonium salts containing long-chain alkyl groups. However, none of these agents impart sufficient smoothness to the fibers.

On the other hand, silicone-based finishing agents are well known to impart high smoothness to the fibers. For example, emulsion-polymerized dimethyl siloxane and amine-modified silicone have been proposed (Japanese Patent Application Publication NO 48-1480). However, both emulsion-polymerized dimethyl siloxane and amine-modified silicone have poor anti-static properties, interfere with the hydrophilic properties of the fiber, and cause the non-woven fabrics to turn yellow.

For imparting hydrophilic properties to fibers, treatment with polyether-modified silicone has been proposed (e.g., Japanese Patent Application Laid-open Nos. 63-303184, 1-148879 and 2-169774). However, polyether-modified silicone imparts hydrophilic properties but does not impart smoothness to fibers. Therefore, highly smooth fibers provided with higher smoothness, anti-static properties, and hydrophilic properties have still been demanded.

SUMMARY OF THE INVENTION

It is the object of the present invention to improve the processability of thermoplastic fibers having a melting point of 120° C. or below, as well as to improve the adhesiveness and tackiness which has been the problem in the above-described prior art. It is another object of the present invention to improve by air flow the evenness of webs produced by fiber opening of fibers comprising thermoplastic resins such as polyolefins.

In other words, the object of the present invention is to provide highly smooth fibers having hydrophilic properties, anti-static properties, and excellent smoothness, as well as fabrics and formed fibrous articles produced by such fibers.

The inventors of the present invention conducted repeated studies for solving the above problems, and found that the above problems were solved by depositing a mixture of special surfactants on the surface of fibers as the finishing agents, and completed the present invention.

According to a first aspect of the present invention, there is provided a highly smooth fiber produced from a thermoplastic resin on which a mixed composition is deposited in an amount of 0.1 to 2.0 percent by weight of said fiber, said mixed composition comprising 50 to 85 percent by weight of a composition (A) consisting of an alkyl phosphate salt having an average number of carbon atoms of 6 to 14 and/or an alkyl phosphate salt having an average number of carbon atoms of 10 to 22 to which a polyoxyalkylene group is added; and 15 to 50 percent by weight of a composition (B) consisting of a polyoxyalkylene modified silicone containing amide group.

According to a second aspect of the present invention, there is provided a highly smooth fiber according to the first aspect, wherein said fiber produced from a thermoplastic resin is a staple having a fiber length of 30 mm or less.

According to a third aspect of the present invention, there is provided a highly smooth fiber according to the first or second aspect, wherein at least one component of the thermoplastic resin constituting said staple has a melting point of 120° C. or below.

According to a fourth aspect of the present invention, there is provided a highly smooth fiber according to any of the first through third aspects, wherein at least one component of the thermoplastic resin constituting said staple is a polyolefin-based resin.

According to a fifth aspect of the present invention, there is provided a highly smooth fiber according to any of the first through third aspects, wherein at least one component of the thermoplastic resin constituting said staple is a polyester-based resin.

According to a sixth aspect of the present invention, there is provided a highly smooth fiber according to any of the first through third aspects, wherein at least one component of the thermoplastic resin constituting said staple is a polyamide-based resin.

According to a seventh aspect of the present invention, there is provided a highly smooth fiber according to any of the first through sixth aspects, wherein the thermoplastic resin constituting said staple is an ethylene-acrylic ester-maleic anhydride terpolymer.

According to an eighth aspect of the present invention, there is provided a highly smooth fiber according to any of the first through seventh aspects, wherein said fiber produced from thermoplastic resins is a composite fiber comprising the first component containing at least 20 percent by weight of an ethylene-acrylic ester-maleic anhydride terpolymer, and forming at least a portion of the surface of said fiber in the lengthwise direction; and the second component consisting of a thermoplastic resin having a melting point at least 20° C. higher than the melting point of the first component.

According to a ninth aspect of the present invention, there is provided a non-woven fabric produced using a highly smooth fiber according to any of the first through eighth aspects.

According to a tenth aspect of the present invention, there is provided a knitted or woven fabric produced using a highly smooth fiber according to any of the first through eighth aspects.

According to an eleventh aspect of the present invention, there is provided a fibrous formed article produced using a highly smooth fiber according to any of the first through eighth aspects.

Figure 1:
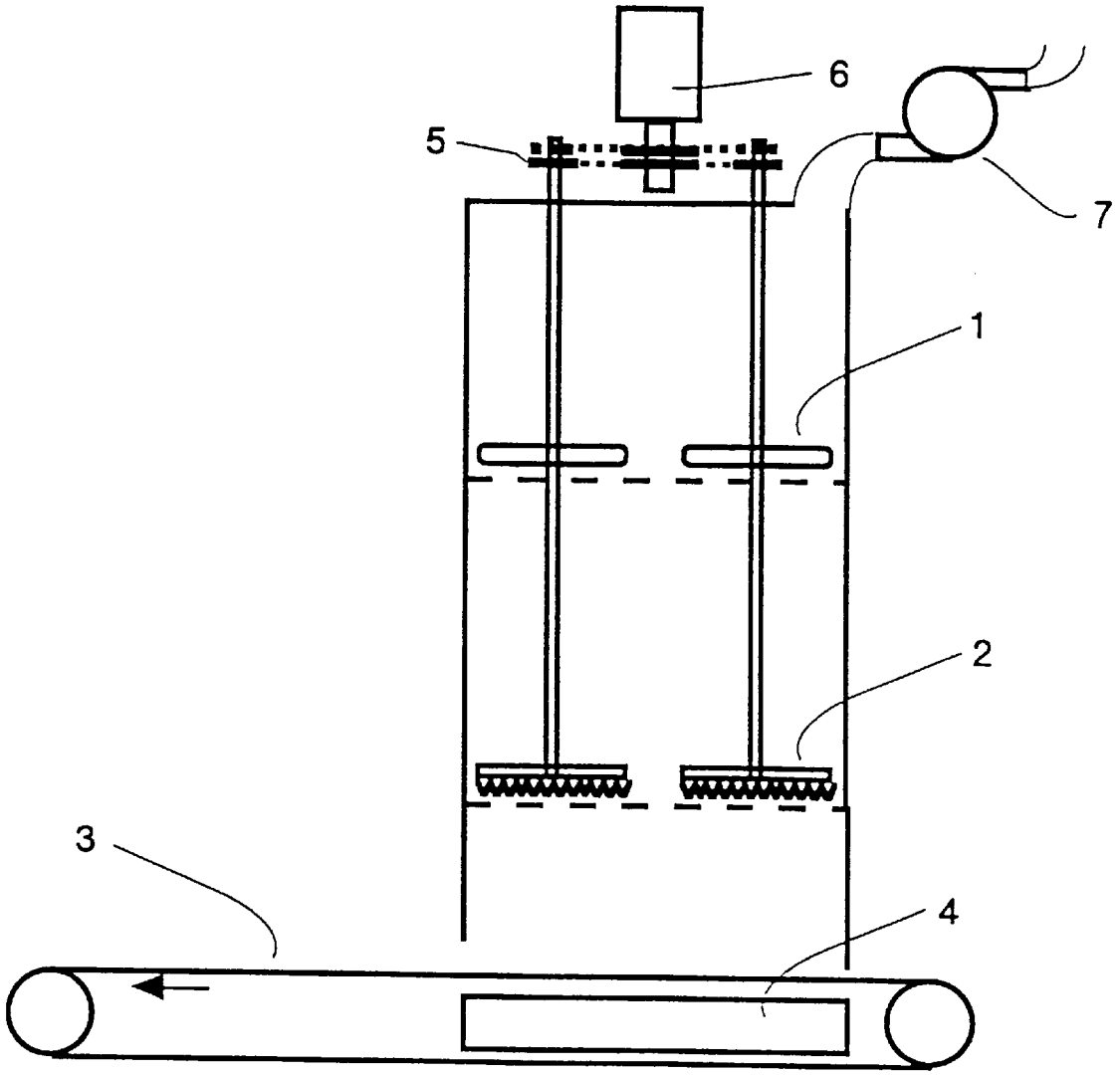
FIG. 1 depicts a front view of simplified air-laid equipment.

Each of the numbers indicated in FIGS. 1 and 2 means parts of the equipment as shown below.

1: First fiber opening blade
2: Second fiber opening blade
3: fiber collecting conveyor
4: Suction
5: Sprocket to rotate fiber opening blades
6: Rotating motor
7: Sample feeding blower

DETAILED DESCRIPTION OF PREFERRED EMBODIMENTS

The present invention will next be described in detail.

Thermoplastic fibers used in the present invention are produced from thermoplastic resins; for example, polyolefin-based, polyester-based, and polyamide-based resins.

Polyolefin-based resins include homopolymer of ethylene or propylene, copolymers of those with other α-olefins, and mixtures thereof. Copolymers with α-olefins include copolymers or terpolymers of olefins, mainly propylene. Specific examples of these copolymers are the copolymers of propylene with ethylene, butene-1 or 4-methylpentene-1.

Ethylene-based copolymers or terpolymers include vinyl ester copolymers such as vinyl acetate; copolymers of unsaturated carboxylic ester such as methyl acrylate, ethyl acrylate, isobutyl acrylate and methyl methacrylate; copolymers of unsaturated carboxylic acid such as acrylic acid, methacrylic acid and maleic anhydride; ethylene-vinyl alcohol copolymer; and vinyl compounds such as vinyl chloride and styrene.

Polyester-based resins include, for example, polyethylene terephthalate, polybutylene terephthalate, poly (ethylene terephthalate-co-ethylene isophthalate), and copolymerized polyether esters.

Depending on applications, mixtures of polyolefin resins with polyester-based resins, polyamide-based resins or elastomers such as ethylene-propylene rubber may be selected.

These thermoplastic fibers may be combined with additives for imparting the functionality to the fibers within the range for achieving the object of the present invention, and the type and amount of these additives may be selected as required.

Next, the mixture of surfactant compositions (A) and (B) used in the present invention (hereafter called "the finishing agent") will be described.

The composition (A) comprises one or more compounds selected from a group consisting of alkyl phosphate salts having an average number of carbon atoms of 6 to 14, and/or alkyl phosphate salts having an average number of carbon atoms of 10 to 22 to which a polyoxyalkylene group is added. The alkyl phosphate salt is preferably a fully-neutralized monophosphate or diphosphate salt of saturated or unsaturated alkyl group having a number of carbon atoms of 6 to 14, preferably 8 to 12, such as octyl alcohol, decyl alcohol, or dodecyl alcohol. These alkyl groups may have side chains. Although the neutralizing salts may include alkali metals such as K and Na, as well as ammonia and amines, alkali metals are preferred from the point of view of anti-static properties.

These alkyl phosphate salts are used for imparting hydrophilic and anti-static properties to fibers. However, if the average number of carbon atoms in the alkyl group is more than 14, the hydrophilic properties become degraded, and if it is less than 6, smoothness decreases.

As the composition (A), a polyoxyalkylene group may be added to the alkyl phosphate salt. The polyoxyalkylene group may be an alkylene oxide such as ethylene oxide, propylene oxide, or butylene oxide; preferably ethylene oxide alone or a random or block copolymer of ethylene oxide and propylene oxide. The number of moles added is 2 to 10 moles, preferably 3 to 7 moles. When a polyoxyalkylene is added, the average number of carbon atoms of the alkyl group is 10 to 22. If the number of carbon atoms is less than 10, smoothness decreases, and if it is more than 22, anti-static properties become degraded.

The amount of the composition (A) added to the finishing agent is 50 to 85 percent by weight, preferably 60 to 80 percent by weight. If the amount is less than 50 percent by weight, anti-static properties are insufficient, and if it exceeds 85 percent by weight, smoothness decreases, and card twining increases.

The typical polyoxyethylene modified silicone containing amide group used as the composition (B) is represented by the following structural formula:

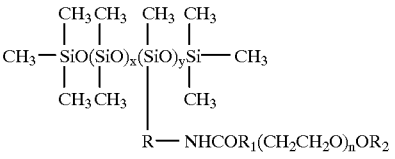

where each of R and $R_1$ is independently a two-valent hydrocarbon group having a number of carbon atoms of 1 to 10, $R_2$ is a monovalent hydrocarbon group having a number of carbon atoms of 10 to 20, n is 1 to 15, each of x and y is independently a number of 1 or more, and x+y is 10 to 2,000.

If x+y in the above formula is less than 10, the composition (B) does not impart smoothness to the fiber, and is x+y exceeds 2,000, the composition (B) is difficult to emulsify, and a stable finishing agent cannot be obtained.

$R_2$ is a monovalent hydrocarbon group having 10 to 20 carbon atoms, and the examples include straight-chain or branched alkyl groups such as undecyl, lauryl, myristyl, and cetyl groups; alkenyl groups such as oleyl groups; alkaryl groups such as octylphenyl and nonylphenyl groups; and aralkyl groups such as phenyloctyl groups.

In the above formula, n is an integer of 1 or more, preferably 3 to 15. If it is less than 1, hydrophilic and anti-static properties lower, and if it is more than 15, smoothness decreases.

The divalent hydrocarbon groups of R and $R_1$ include alkylene groups such as methylene, ethylene and trimethylene groups; and alkylene aryl groups such as —$C_2H_4$—$C_6H_4$—; preferably alkylene groups, and more preferably methylene group.

The amount of the composition (B) in the finishing agent is 15 to 50 percent by weight, preferably 20 to 40 percent by weight. If the amount is less than 15 percent by weight, smoothness decreases, and if it exceeds 50 percent by weight, anti-static properties become poor.

Compositions other than compositions (A) and (B) required for the thermoplastic resin constituting the fibers, fabrics, or formed articles may be added to the finishing agent within the range to achieve the object of the present invention.

The amount of the finishing agent deposited on the above thermoplastic fibers is 0.1 to 2.0 percent by weight, preferably 0.3 to 1.5 percent by weight.

If the amount is less than 0.1 percent by weight, anti-static properties, hydrophilic properties, and smoothness of the fibers become poor, and if it exceeds 2.0 percent by weight, problems will arise such as twining to the cylinder in the carding process and tackiness of the fabrics.

The methods for depositing these finishing agents on thermoplastic fibers are not limited to a specific method, but may be any methods known to the art, such as deposition by contacting with an oiling roll, immersing in a dip tank, and spraying during spinning or drawing processes, as well as deposition, after processing, onto laminated fibers such as webs, fabrics such as non-woven fabric, or formed articles, by contacting, immersing, or spraying.

The highly smooth fibers of the present invention are the above thermoplastic fibers on which a finishing agent is deposited, and their profile structure may be either a single or composite structure. The cross-sectional form of the fiber may be circular or deformed or hollow.

The form of the fiber may be altered depending on the method for processing into fabrics or formed articles. In the fiber laminating method using air flow opening such as the air-laid method, staples of a length of 30 mm or less produce evenly opened fiber laminates, whether crimped or not. In particular, although fibers containing a thermoplastic resin of a low melting point of 120° C. or below or an adhesive or tacky thermoplastic resin cannot be opened evenly as they are, due to the large fiber friction produced, the highly smooth fibers on which the finishing agent of the present invention is deposited produce highly even webs due to reduced friction between fibers. Also in spinning processes such as fine spinning, spun yarns having a low melting point or adhesiveness, which were difficult to produce in conventional methods, may be produced because of small amounts of fiber-metal friction.

Regarding the function of the finishing agent, the behavior of a sheath-and-core type composite fiber in dry opening will next be described.

Sheath-and-core type composite fibers having adhesiveness with other materials, which is a high functionality, have been used. In order to impart adhesiveness with other materials to these fibers, a ethylene-ethyl acrylate-maleic anhydride terpolymer (melting point=80° C., melt flow rate=20 g/10 min at 190° C.) is used for the sheath component. Since these fibers produce much fiber—fiber and fiber-metal friction in the carding process, ordinary finishing agent prevents the generation of static electricity, but cannot open fibers sufficiently due to much fiber—fiber friction being produced, resulting in uneven webs. By the use of the finishing agent of the present invention, however, fiber—fiber friction is reduced because of excellent anti-static properties and smoothness, and highly even webs are produced.

As another example, a sheath-and-core type composite fiber consisting of hydrophobic thermoplastic resins such as low-density polyethylene/polypropylene cannot produce evenly laminated fibers in the fiber laminating process using air-flow opening, because the fiber itself is strongly hydrophobic, and static electricity is generated in fibers due to friction between fibers and between equipment and fibers. Therefore, the speed of the equipment must be lowered, and the equipment must be cleaned very often, both causing productivity to lower.

On the other hand, the sheath-and-core type composite fiber on which the finishing agent of the present invention has been applied excels in smoothness and anti-static properties and can be opened evenly, and little static electricity is generated between fibers or between equipment and fibers.

Also, among smooth fibers of the present invention, side-by-side type, sheath-and-core type, radially split type and sea-and-island type composite fibers maintain the shape of absorbing materials by mixing and heat-treating the cut staples with water-absorbing materials such as pulp or high polymers absorbent. Although ordinary thermoplastic composite fibers are difficult to mix uniformly with pulp and the like because of static electricity generated due to friction between fibers, the smooth fibers of the present invention slightly lower water-absorbing properties, produce slight unevenness of the absorbing materials, and excel in water dispersion, because of their excellent hydrophilic properties and smoothness.

Smooth fibers, fabrics, and formed articles of the present invention can be used for producing adhesive sheets, elastic non-woven fabrics, shock absorbers, yarn to prevent spining yarn from getting untied, shape maintenance of absorbing materials, water-diffusing membranes, absorbing pads, structural reinforcing fibers in civil engineering and construction fields, and fiber-blended mats with other fibers.

EXAMPLES

The present invention will be described in further detail by way of referring to examples, but the present invention is not limited to the following Examples and Comparative Examples, as far as the scope of the present invention is not exceeded.

In these Examples, the following methods were used for evaluating properties.

(1) Anti-static property: A web was produced from 40 g of sample fibers of a length of 51 mm using a test carding machine at a temperature of 20° C., a relative humidity of 45%, and a speed of 7 m/min; and the voltage of static electricity generated in the web was measured. The results were evaluated according to the following criteria. When the voltage was lower than 100 V, the web was evaluated to be suitable for practical use.

○: Less than 100 V

Δ: 100 V or more, and less than 500V

X: 500 V or more (2) Card twining: A web was produced from 40 g of sample fibers of a length of 51 mm using a miniature test carding machine at a temperature of 30° C., a relative humidity of 80%, and a speed of 7 m/min. The machine was subsequently stopped, and the cylinder was visually observed. The results were evaluated according to the following criteria.

○: No twining

Δ: Partial twining

X: Almost complete twining (3) State of web 1: The state of the web produced in the above method was observed, and the results were evaluated according to the following criteria.

○: Web is even, without neps.

Δ: Some neps are produced.

X: Web is uneven.

(4) Hydrophilic property of fiber: A cylindrical basket having a diameter of 3 cm, a height of 8 cm, a weight of 3 g and made of copper wire net was filled with 5 g of the sample having a fiber length of 51 mm and finely carded using a miniature carding machine, and was allowed to float on the surface of water in a water vessel at 25° C. The time was measured until the sample, together with the basket, sank in water.

When the time was 10 seconds or less, the hydrophilic property was evaluated as good; when the time was 30 seconds or more, the hydrophilic property was evaluated as poor and represented by X.

(5) Hydrophilic property of non-woven fabric: A web produced using a miniature carding machine was heat-treated using a suction drier (processing time=20 seconds, wind velocity=2 m/sec, heating temperature=133°) to form a non-woven fabric. On the surface of the resultant non-woven fabric having a METSUKE (weight per unit area) of 25 g/m$^2$, 10 drops of water were dropped from a height of 1 cm using a pipette at a temperature of 20° C. and a relative humidity of 45%, and the number of droplets which disappeared within 30 seconds was counted.

(6) State of web 2: Webs were produced from sample fibers of lengths of 3, 5, 10, 30 and 45 mm using air-laid equipment shown in FIGS. 1 and 2, and evaluated for their ability to be opened.

Figure 2:
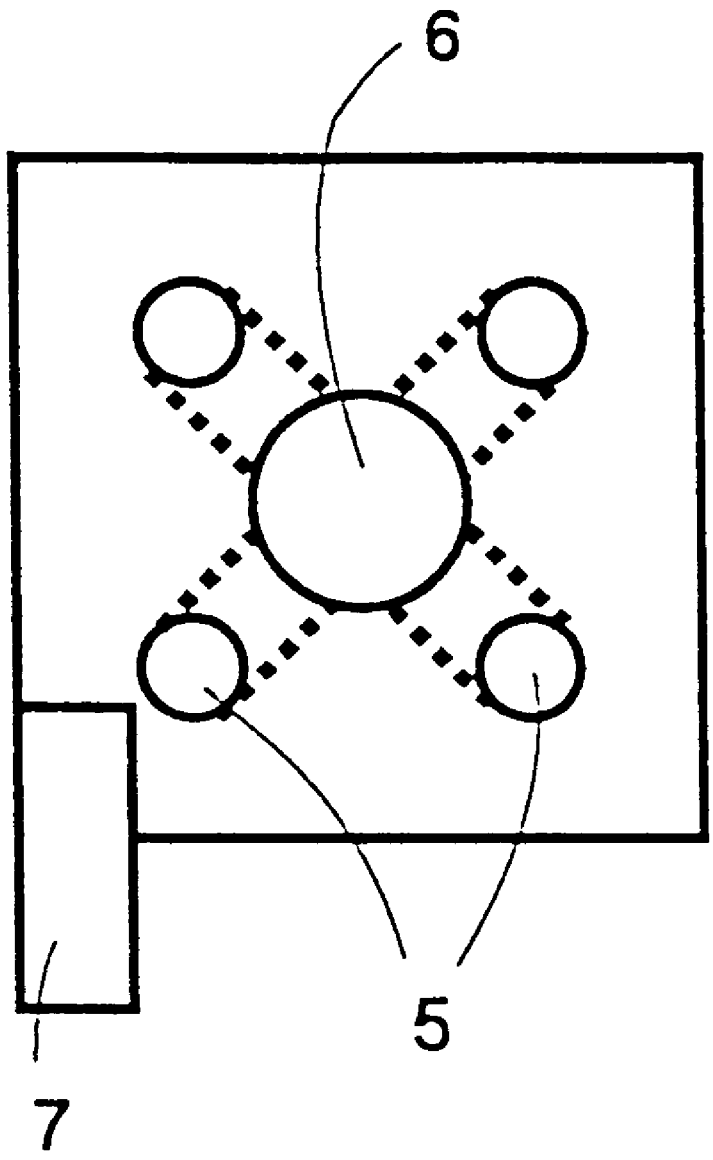
FIG. 2 depicts a top view of the main part of the simplified air-laid equipment.

The fibers fed from the sample feeding blower 7 were opened by the first opening blade 1 and the second opening blade 2 rotated by the opening blade rotating sprocket 5 connected to the rotating motor 6, and fell onto the fiber collecting conveyor 3 moving in the direction indicated by the arrow in FIGS. 1 and 2. A web was produced in such a way, the state of the web was visually observed, and evaluated according to the following criteria.

○: Well opened, even web

Δ: Partially un-opened

X: Insufficiently opened, uneven web

EXAMPLE

Examples 1–11, Comparative Examples 1–11

Fibers having a fineness of 2 deniers were produced to have profiles of a single structure (single type), a sheath-and-core structure, a side-by-side structure, a structure radially divided into 16 portions (split type), and a sea-and-island structure (sea-and-island type) were produced from a thermoplastic resin consisting of the following components using a conventional melt spinning method, and physical properties were evaluated after depositing the finishing agent indicated in Table 1 and 2 on the fibers.

Component A: Polypropylene

230° C. melt flow rate (hereafter abbreviated as MFR)=18 g/10 min

Component B: Polyester

Inherent viscosity measured in o-chlorophenol at 35° C., IV=0.65

Component C: Low-density polyethylene

MFR at 190° C.=20 g/10 min

Component D: Ethylene-methyl acrylate-maleic anhydride terpolymer

MFR at 190° C.=14 g/10 min

Component E: a blend of ethylene-propylene rubber (MFR at 190° C.=4.5 g/10 min) and low-density polyethylene (MFR at 190° C.=20 g/10 min)=3/7 by weight Component F: High-density polyethylene MFR at 190° C.=15 g/10 min

Examples 12–17, Comparative Examples 12–16

Fibers of a fineness of 2 deniers were produced using thermoplastic resins of compositions A to F in the same way as in Examples 1 to 11. Finishing agents of various compositions shown in Table 3 were deposited on these fibers, the fibers were cut, and webs were produced using air-laid equipment.

TABLE 1

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| A | | | | | | | | | | | |
| Octyl phosphate K-salt | 70 | 20 | 50 | | | | 85 | 50 | | 70 | 70 |
| Lauryl phosphate K-salt | | 50 | | 30 | | 50 | | | 35 | | |
| POE(5) Lauryl phosphate K-salt | | | 20 | | 50 | | | 35 | 50 | | |
| POE(5) Myristyl phosphate K-salt | | | | 20 | | | | | | | |
| B | | | | | | | | | | | |
| Amide polyoxyethylene modified silicone*1 | 30 | 30 | 30 | 50 | 50 | 50 | 15 | 15 | 15 | 30 | 30 |
| Dimethyl silicone emulsion (Mw = 1 million) | | | | | | | | | | | |
| Amine modified silicone*2 | | | | | | | | | | | |
| Polyether modified silicone (EO modified)*3 | | | | | | | | | | | |
| Stearyl phosphate K-salt | | | | | | | | | | | |
| (C24) Alkyl phosphate K-salt POE(5) | | | | | | | | | | | |
| Amount of deposition (%) | 0.5 | 0.5 | 0.5 | 0.5 | 0.5 | 0.5 | 0.5 | 0.5 | 0.5 | 0.3 | 1.5 |

TABLE 1-continued

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Resin | | | | | | | | | | | |
| Fiber structure | Sheath-core | Sheath-core | Sheath-core | Sheath-core | Sea-island | Single | Sheath-core | Split | Split | Sheath-core | Sheath-core |
| First component (core, island etc.) | A | B | A | B | A | E | A | A | A | A | A |
| Second component (sheath, sea, etc.) | D | D | D | C | D | | E | C | C | D | D |
| Card twining | | | | | | | | | | | |
| Anti-static properties | ○ | ○ | ○ | ○ | ○ | ○ | ○ | ○ | ○ | ○ | ○ |
| Card twining | ○ | ○ | ○ | ○ | ○ | ○ | ○ | ○ | ○ | ○ | ○ |
| State of web 1 | ○ | ○ | ○ | ○ | ○ | ○ | ○ | ○ | ○ | ○ | ○ |
| Hydrophilic properties | 3.1 | 3.4 | 3.5 | 4.5 | 4.3 | 4.0 | 3.0 | 3.5 | 3.5 | 4.0 | 3.1 |
| Non-woven fabric | | | | | | | | | | | |
| Hydrophilic properties | 10 | 10 | 10 | 10 | 10 | 10 | 10 | 10 | 10 | 10 | 10 |

TABLE 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 | Comparative Example 11 |
|---|---|---|---|---|---|---|---|---|---|---|---|
| A | | | | | | | | | | | |
| Octyl phosphate K-salt | 70 | 70 | 70 | | | 70 | 70 | 100 | | 40 | 90 |
| Lauryl phosphate K-salt | | | | | | | | | | | |
| POE(5) Lauryl phosphate K-salt | | | | | | | | | | | |
| POE(5) Myristyl phosphate K-salt | | | | | | | | | | | |
| B | | | | | | | | | | | |
| Amide polyoxyethylene modified silicone*1 | | | | 30 | 30 | 30 | 30 | | 100 | 60 | 10 |
| Dimethyl silicone emulsion (Mw = 1 million) | 30 | | | | | | | | | | |
| Amine modified silicone*2 | | 30 | | | | | | | | | |
| Polyether modified silicone (EO modified)*3 | | | 30 | | | | | | | | |
| Stearyl phosphate K-salt | | | | 70 | | | | | | | |
| (C24) Alkyl phosphate K-salt POE(5) | | | | | 70 | | | | | | |
| Amount of deposition (%) | 0.5 | 0.5 | 0.5 | 0.5 | 0.5 | 0.07 | 2.5 | 0.5 | 0.5 | 0.5 | 0.5 |
| Resin | | | | | | | | | | | |
| Fiber structure | Sheath-core | Sheath-core | Sheath-core | Sheath-core | Sheath-core | Sheath-core | Sheath-core | Sheath-core | Sheath-core | Sheath-core | Sheath-core |
| First component (core, island, etc.) | A | A | A | A | A | A | A | A | A | A | A |
| Second component (sheath, sea etc.) | D | D | D | D | D | D | D | D | D | D | D |
| Card twining | | | | | | | | | | | |
| Anti-static properties | Δ | Δ | ○ | Δ | Δ | X | ○ | ○ | Δ | Δ | ○ |
| Card twining | ○ | ○ | Δ | Δ | Δ | X | X | Δ | X | ○ | Δ |
| State of web | ○ | ○ | ○ | ○ | Δ | X | X | Δ | X | Δ | Δ |
| Hydrophilic properties | X | X | 3.1 | X | 12.2 | X | 3.0 | 3.0 | 28.4 | 4.5 | 1.1 |
| Non-woven fabric | | | | | | | | | | | |
| Hydrophilic properties | 0 | 0 | 10 | 0 | 4 | 0 | 10 | 10 | 4 | 10 | 10 |

TABLE 3

| | Example 12 | Example 13 | Example 14 | Example 15 | Example 16 | Example 17 | Comparative Example 12 | Comparative Example 13 | Comparative Example 14 | Comparative Example 15 | Comparative Example 16 |
|---|---|---|---|---|---|---|---|---|---|---|---|
| Octyl phosphate K-salt | 70 | 70 | 70 | 30 | 30 | 50 | 70 | 70 | 70 | 70 | 70 |
| POE(5) Lauryl phosphate K-salt | | | | 40 | 20 | | | | | | |
| Amide polyoxyethylene modified silicone*1 | 30 | 30 | 30 | 30 | 50 | 50 | | | | 30 | 30 |
| Dimethyl silicone emulsion (Mw = 1 million) | | | | | | | 30 | | | | |
| Amine modified silicone*2 | | | | | | | | 30 | | | |
| Polyether modified silicone (EO modified)*3 | | | | | | | | | 30 | | |
| Amount of deposition (%) | 0.5 | 1.0 | 0.2 | 0.5 | 0.5 | 0.5 | 0.5 | 0.5 | 0.5 | 0.5 | 2.5 |
| Fiber | | | | | | | | | | | |
| Fiber structure | Sheath-core | Single | Sheath-core | Sheath-core | Sheath-core | Split | Sheath-core | Sheath-core | Sheath-core | Sheath-core | Single |
| First component (core, island etc.) | A | E | B | A | A | A | A | A | A | A | E |
| Second component (sheath, sea etc.) | D | | C | E | D | F | D | D | D | D | |
| Fiber length (mm) | 10 | 10 | 5 | 10 | 3 | 30 | 10 | 10 | 10 | 45 | 10 |
| Air-laid | | | | | | | | | | | |
| State of web 2 | ○ | ○ | ○ | ○ | ○ | ○ | X | Δ | Δ | X | X |

The details of compounds shown in Tables 1 to 3 are as follows:

*1 Polyoxyethylene modified silicone containing amide group $$(CH_3)_3SiO[(SiO)(CH_3)_2]_{200}[(SiO)(CH_3)_2]_{20}Si(CH_3)_3$$
$$|$$
$$(CH_2)_3NHCOCH_2(CH_2CH_2O)_8OC_{14}H_{29}$$

*2 Amine modified silicone $$(CH_3)_3SiO[(SiO)(CH_3)_2]_{200}[(SiO)(CH_3)_2]_{10}Si(CH_3)_3$$
$$|$$
$$(CH_2)_3NH_2$$

*3 Polyether modified silicone $$(CH_3)_3SiO[(SiO)(CH_3)_2]_{100}[(SiO)(CH_3)_2]_{20}Si(CH_3)_3$$
$$|$$
$$(CH_2)_3O(CH_2CH_2O)_{20}H$$

Since smooth fibers consisting of the thermoplastic fibers of the present invention excel in hydrophilic and anti-static properties as well as in smoothness, the processability of thermoplastic fibers having low melting points or thermoplastic fibers having adhesiveness or tackiness and having large fiber—fiber and fiber-metal friction is improved. Therefore, the webs produced by smooth fibers of the present invention produce no neps, and fabrics or formed articles of the present invention maintain good evenness.

Even webs may be produced also from ordinary thermoplastic fibers such as polyolefins by fiber opening using air flow.

We claim:

1. A highly smooth fiber comprising a fiber produced from a thermoplastic resin on which a mixed composition is deposited in an amount of 0.1 to 2.0 percent by weight of said fiber, said mixed composition comprising 50 to 85 percent by weight of a composition (A) consisting of an alkyl phosphate salt having an average number of carbon atoms of 6 to 14 and/or an alkyl phosphate salt having an average number of carbon atoms of 10 to 22 to which a polyoxyalkylene group is added; and 15 to 50 percent by weight of a composition (B) consisting of a polyoxyalkylene modified silicone containing an amide-group.

2. The highly smooth fiber according to claim 1, wherein said fiber produced from a thermoplastic resin is a staple having a fiber length of 30 mm or less.

3. The highly smooth fiber according to claim 2, wherein at least one component of the thermoplastic resin constituting said staple has a melting point of 120° C. or below.

4. The highly smooth fiber according to claim 2, wherein at least one component of the thermoplastic resin constituting said staple is a polyolefin-based resin.

5. The highly smooth fiber according to claim 2, wherein at least one component of the thermoplastic resin constituting said staple is a polyester-based resin.

6. The highly smooth fiber according to claim 2, wherein at least one component of the thermoplastic resin constituting said staple is a polyamide-based resin.

7. The highly smooth fiber according to claim 2, wherein the thermoplastic resin constituting said staple is an ethylene-acrylic ester-maleic anhydride terpolymer.

8. The highly smooth fiber according to claim 1, wherein said fiber produced from thermoplastic resins is a composite fiber comprising the first component containing at least 20 percent by weight of an ethylene-acrylic ester-maleic anhydride terpolymer, and forming at least a portion of the surface of said fiber in the lengthwise direction; and the second component consisting of a thermoplastic resin having a melting point at least 20° C. higher than the melting point of the first component.

9. A non-woven fabric comprising a highly smooth fiber according to claim 1.

10. A knitted or woven fabric produced by using a highly smooth fiber according to claim 1.

11. A fibrous formed article comprising a highly smooth fiber according to claim 1.

* * * * *